US006142728A

United States Patent [19]

Humburg et al.

[11] Patent Number: 6,142,728

[45] Date of Patent: Nov. 7, 2000

[54] SIDE CHANNEL BLOWER, IN PARTICULAR FOR SUPPLYING COMBUSTION AIR TO THE AUXILIARY HEATER OF A MOTOR VEHICLE

[75] Inventors: Michael Humburg, Göppingen; Hermann Eppler, Balingen, both of Germany

[73] Assignee: J. Eberspächer GmbH & Co., Germany

[21] Appl. No.: 09/202,209

[22] PCT Filed: Jun. 3, 1997

[86] PCT No.: PCT/DE97/01143

§ 371 Date: Dec. 8, 1998

§ 102(e) Date: Dec. 8, 1998

[87] PCT Pub. No.: WO97/48906

PCT Pub. Date: Dec. 24, 1997

[30] Foreign Application Priority Data

Jun. 19, 1996 [DE] Germany ..... 196 24 364

[51] Int. Cl.[7] ..... F04D 23/00

[52] U.S. Cl. ..... 415/55.1; 415/55.7; 237/12.3 R

[58] Field of Search ..... 415/55.1, 55.2, 415/55.3, 55.4, 55.5, 55.6, 55.7; 237/12.3 C, 12.3 R

[56] References Cited

U.S. PATENT DOCUMENTS 3,951,567 4/1976 Rohs ..... 415/55.3

FOREIGN PATENT DOCUMENTS 403105095 5/1991 Japan ..... 415/55.4

*Primary Examiner*—Edward K. Look
*Assistant Examiner*—Liam McDowell
*Attorney, Agent, or Firm*—McGlew & Tuttle, P.C.

[57] ABSTRACT

A side channel blower (1), in particular for supplying combustion air to the auxiliary heater (2) of a motor vehicle, has a body (3) axially connected to an impeller wheel (4). The blower body (3) has an inlet channel (5), an outlet channel (6), a curved side channel (8) at the axial connection side (7) with the impeller wheel for connecting the inlet channel to the outlet channel, and a separating piece (9) which form together the 360° of the circumference of the axial connection side (7). The separating piece (9) is produced as a separate part, in particular as a casting. This is advantageous for the manufacture and for optimizing the noise level and aerodynamics of the blower.

13 Claims, 3 Drawing Sheets

SIDE CHANNEL BLOWER, IN PARTICULAR FOR SUPPLYING COMBUSTION AIR TO THE AUXILIARY HEATER OF A MOTOR VEHICLE

FIELD OF THE INVENTION

The present invention pertains to a side-channel fan, especially for feeding combustion air in a parking heater or auxiliary heater of a motor vehicle, with a fan body part in an axial connection to an impeller, wherein the fan body part has an inlet channel and an outlet channel and, on the axial connection side of the impeller, a bent side-channel, which connects the inlet channel to the outlet channel, and a separating web, which together form the 360° circumference of the axial connection side.

BACKGROUND OF THE INVENTION

A side-channel fan of the above-described type has been known from DE 42 30 014 C1. The side-channel and the separating web are an integrated part of the fan body. The separating web, which is also called an interrupter, has baffling means in the form of material recesses, e.g., notch-like recesses, which reduce the generation of noise during the operation of the fan.

The difficult and expensive manufacture of the fan body is a drawback. Complex, spatially difficult flow channels or baffling means can be brought about to a limited extent only. Flow optimization and noise optimization and minimization are therefore possible to a limited extent only.

SUMMARY AND OBJECTS OF THE INVENTION

The object of the present invention is to provide a side-channel fan of the above-described type, which makes it possible to optimize the noise and flow with simple means.

According to the invention, a side-channel blower is provided especially for feeding combustion air in a parking heater of a motor vehicle. The blower has a fan body part in an axial connection to an impeller. The fan body part has an inlet channel and an outlet channel and, on the axial connection side of the impeller, a side channel connecting the inlet channel to the outlet channel and a separating web, which together form the 360° circumference of the axial connection side. The separating web is a separate component.

The essence of the present invention is to make the fan body part and the combustion air fan housing in two parts, wherein the separating web between the inlet and outlet is a separate component, especially a separate molding, especially a casting.

As a result, the separating web per se may be shaped in a nearly freely selectable manner, and the side-channel or the ring channel and especially also the inlet and outlet openings per se can also be shaped better. There are more degrees of freedom and more possibilities for optimizing the flow conditions of the combustion air and the generation of noise. According to the state of the art, the one-piece design of a fan body, undercuts at the separating web are possible only conditionally for reasons of the casting technology. The present invention makes possible development variants that are precisely not possible according to the state of the art. In particular, simple development work can be performed on the fan according to the present invention. It is possible, e.g., to use different separating web configurations in the same basic fan body, i.e., the flow conditions are changed in a comparatively simple manner in order to finally obtain an optimal solution.

In a preferred variant of the present invention, the separating web has a flat surface, which is located in the close, contact-free proximity of the impeller.

The flat surface preferably has individual contours, wherein a first contour is associated with the inlet opening of the inlet channel and a second contour is associated with the outlet opening of the outlet channel. The first and second contours may be profiled as desired, e.g., made concave or convex, straight, jagged and/or wave-shaped corresponding to an individual application in order to optimize the flow and noise conditions.

A third, preferably concave, round contour, which adjoins the thrust bearing of the impeller, may be provided between the first and second contours.

A fourth, convex, round contour extends coaxially to the third round contour and preferably forms the extension of a circular outer circumference of the sidechannel.

It is especially advantageous for the separating web to have a shaped projection on the side facing away from the flat surface, which said projection forms a partial circumference of an area of the outlet channel and/or of the inlet channel, wherein the latter area extends, in particular, essentially radially in an outlet channel relative to the impeller.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
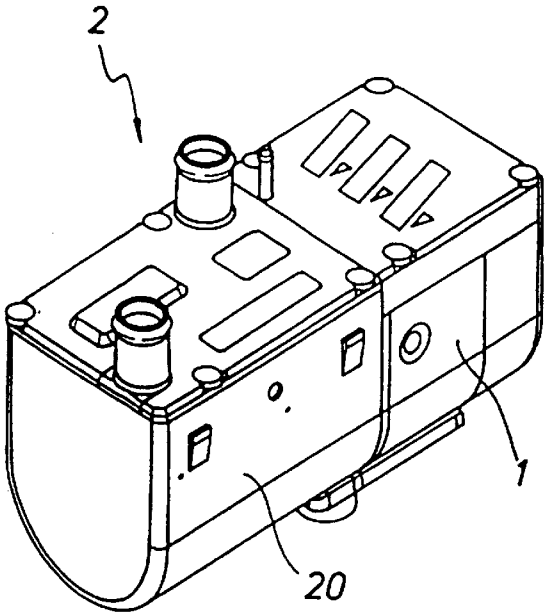
FIG. 1 is a schematic perspective view of a parking heater of a motor vehicle with a side-channel fan for feeding combustion air to a burner with heat exchanger.

According to FIG. 1, a side-channel fan 1, which is connected to a burner 20 with heat exchanger and supplies the burner 20 with combustion air during the operation, is provided for a parking heater 2 or auxiliary heater of a motor vehicle.

Figure 2:
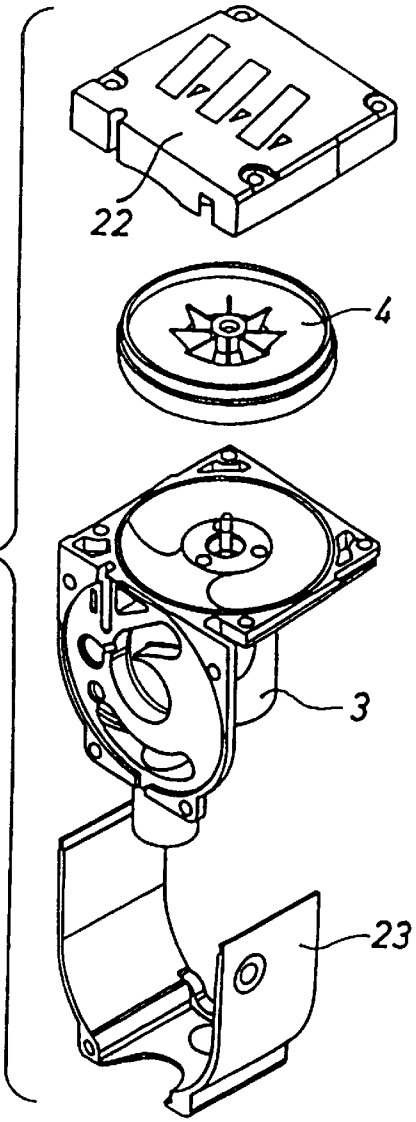
FIG. 2 is a schematic exploded view of the side-channel fan according to FIG. 1 with a central fan body part.

Besides an upper and lower cover 22, 23 each, the side-channel fan 1 has an impeller 4 and a fan body part 3 in an axial connection to the impeller 4, as it can be seen especially in the exploded view in FIG. 2.

Figure 3:
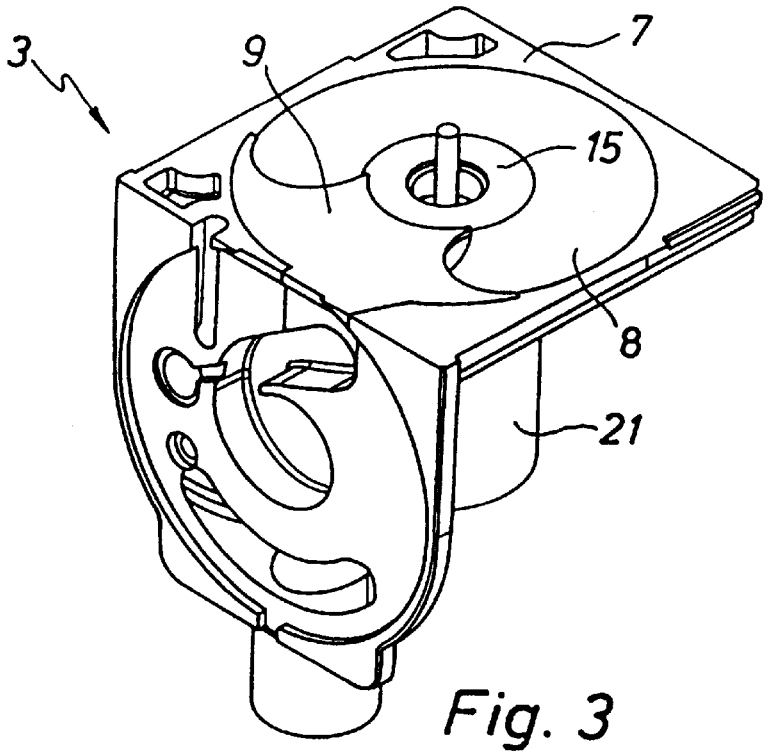
FIG. 3 is an enlarged perspective view of the fan body part according to FIG. 3.
Figure 4:
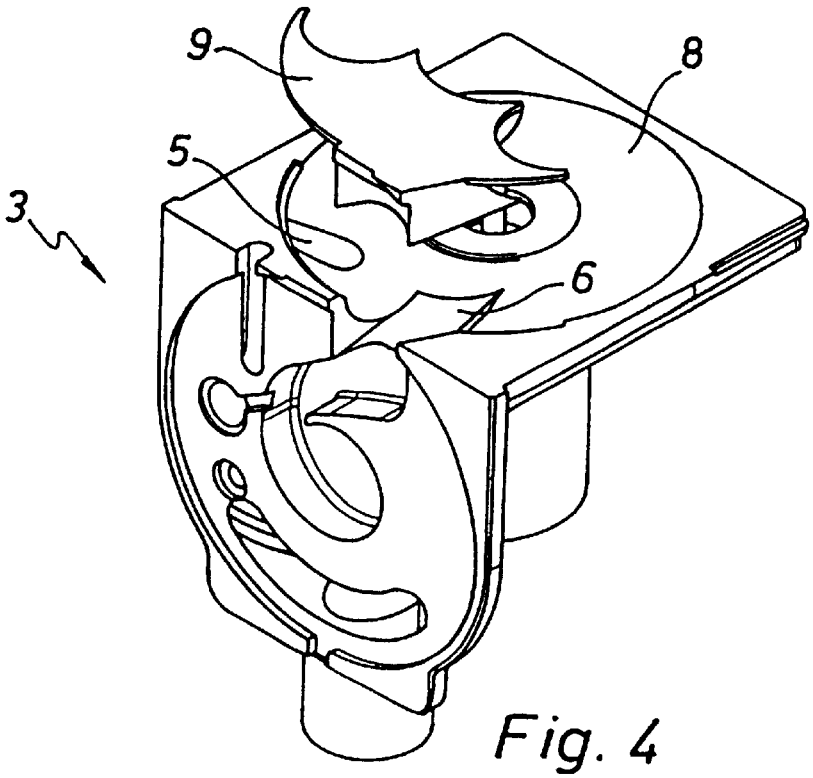
FIG. 4 is an exploded view of the fan body part according to FIG. 3.
Figure 5:
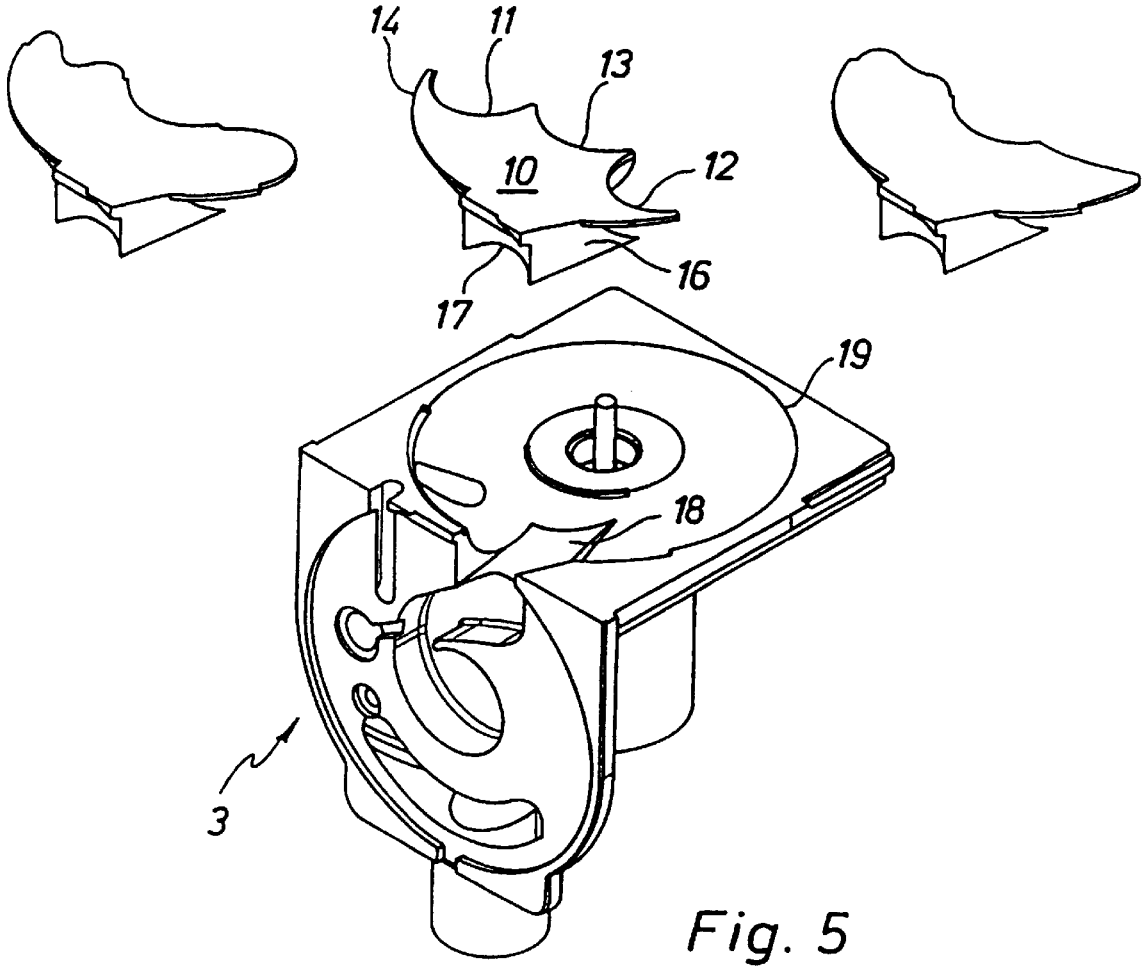
FIG. 5 is a perspective view of the fan body part according to FIG. 4 with representation of different separating web configurations with the basic fan body being the same.

The fan body part 3 that is of interest here is shown as a detail on a larger scale in FIGS. 3, 4 and 5.

The fan body part is made in two parts as a casting. It has an inlet channel 5 for the supply of combustion air from the atmosphere and an outlet channel 6 for drawing off the accelerated combustion air to the combustion chamber of the burner 20.

On the axial connection side 7 of the impeller 4, the fan body part 3 has a bent side-channel 8 of a half-toric shape, which connects the inlet channel 5 to the outlet channel 6, and in which the combustion air is accelerated during operation by the impeller 4 driven by an electric motor 21.

The side-channel 8 extends on the axial connection side 7 over an arc of about 270°. The rest of the axial connection side 7 is essentially a separating web 9, which is a separate component, especially a diecast part.

The separating web 9 located between the inlet channel 5 and the outlet channel 6 has, in particular, a flat surface 10 and otherwise an underside of a complex configuration in the form of a shaped projection 16, which creates wall areas of the inlet channel 5, which are favorable for flow, and wall areas of the outlet channel 6, which are favorable for flow, in the area of the side-channel 8. The flat surface 10 of the separating web 9 is located in the immediate, contact-free proximity of a mounted impeller 4 and has, in the top view of the drawing, individual contours 11, 12, 13, 14 in the form of round and profiled sections.

A first contour 11 defines a part of the inlet opening, through which the combustion air passes through the inlet channel 5 and into the side-channel 8.

A second contour 12 determines part of the outlet opening, through which the accelerated combustion air is delivered from the side channel 8 through the outlet channel 6 in the direction of the combustion chamber of the burner 20.

A third concave contour 13, located between the first contour 11 and the second contour 12, is used to center the separating web 9 at the axial drive or thrust bearing 15 of the impeller 4.

Finally, a fourth, convex round contour 14 of the flat surface 10 of the separating web 9 is provided coaxially to the third round contour 13, which forms, e.g., the arc-shaped extension of the circular outer circumference 19 of the side channel 8.

The first contour 11 of the inlet opening and the second contour 12 of the outlet opening may be configured as desired and may be made, e.g., concave arc-shaped according to the center of FIG. 5, convex, arc-shaped or wave-shaped according to FIG. 5, right, or partly straight according to FIG. 5, left.

Due to the two-part design of the fan body part 3, the separating web 9 may consequently be shaped as a separate molding in itself nearly as desired and be adapted to individual flow conditions. The side or ring channel may likewise be designed in itself better, especially in the area of the inlet and outlet openings, in order to establish optimal flow and noise conditions in a side-channel fan.

While specific embodiments of the invention have been shown and described in detail to illustrate the application of the principles of the invention, it will be understood that the invention may be embodied otherwise without departing from such principles.

What is claimed is:

1. A side-channel blower, for feeding combustion air in a parking heater of a motor vehicle, comprising:

an impeller;

a fan body part with a side with a axial connection to said impeller, said fan body part having an inlet channel and an outlet channel and, on said side with said axial connection to said impeller, a bent side channel connecting said inlet channel to said outlet channel;

a separating web which is a separate component from said fan body part, said separating web together with said side channel forming a 360° circumference of said side with said axial connection to an impeller, said separating web having a flat surface which is located in a close, contact-free proximity of said impeller, said flat surface having a flow- and noise-optimized first contour and a flow- and noise-optimized second contour, wherein said first contour is associated with an inlet opening of said inlet channel and said second contour is associated with an outlet opening of said outlet channel, and said first contour forms a profiled part of said inlet opening and said second contour forms a profiled part of said outlet opening;

said fan body part having an impeller bearing wherein said flat surface has a third, concave round contour, which is located between said first and second contours and adjoins said impeller bearing.

2. The side-channel fan in accordance with claim 1, wherein said first and second contours are concave, convex, jagged, wave-shaped or partially straight.

3. The side-channel fan in accordance with claim 1, wherein said third, concave round contour is in contact with said impeller bearing.

4. The side-channel fan in accordance with claim 1, wherein said flat surface has a fourth, concave round contour, which extends coaxially to said third round contour and forms an extension of a circular outer circumference of said side channel.

5. The side-channel fan in accordance with claim 1, wherein on a side facing away from said flat surface, said separating web has a shaped projection, which forms a partial circumference of an area of one of said outlet channel and of said inlet channel.

6. The side-channel fan in accordance with claim 5, wherein said shaped projection forms a partial circumference of an area of said outlet channel, said area being essentially radial in relation to said impeller.

7. The side-channel fan in accordance with claim 1, wherein said separating web is a separate mold-cast diecast part.

8. A side-channel blower, comprising:

an impeller;

a fan body part with a side with an axial connection to said impeller, said fan body part having an inlet channel and an outlet channel and, on said side with said axial connection to said impeller, a curved side channel connecting said inlet channel to said outlet channel;

a separating web which is a separate component from said fan body part, said separating web together with said side channel forming a 360° circumference of said side with said axial connection to an impeller, said separating web having a flat surface which is located in a close, contact-free proximity of said impeller, said flat surface having a flow- and noise-optimized first contour and a flow- and noise-optimized second contour, wherein said first contour is associated with an inlet opening of said inlet channel and said second contour is associated with an outlet opening of said outlet channel, and said first contour forms a profiled part of said inlet opening and said second contour forms a profiled part of said outlet opening;

said fan body part having an impeller bearing wherein said flat surface has a third, concave round contour, which is located between said first and second contours and adjoins said impeller bearing.

9. The side-channel fan in accordance with claim 8, wherein said first and second contours are concave, convex, jagged, wave-shaped or partially straight.

10. The side-channel fan in accordance with claim 8, wherein said third, concave round contour is in contact with said impeller bearing.

11. The side-channel fan in accordance with claim 8, wherein said flat surface has a fourth, concave round contour, which extends coaxially to said third round contour and forms an extension of a circular outer circumference of said side channel.

12. The side-channel fan in accordance with claim 8, wherein said separating web is a separate mold-cast diecast part.

13. A side-channel blower, comprising:

an impeller;

a fan body part with a side with an axial connection to said impeller, said fan body part having an inlet channel and an outlet channel and, on said side with said axial connection to said impeller, a curved side channel connecting said inlet channel to said outlet channel;

a separating web which is a separate component from said fan body part, said separating web together with said side channel forming a 360° circumference of said side with said axial connection to an impeller, said separating web having a flat surface which is located in a close, contact-free proximity of said impeller, said flat surface having a flow- and noise-optimized first contour and a flow- and noise-optimized second contour, wherein said first contour is associated with an inlet opening of said inlet channel and said second contour is associated with an outlet opening of said outlet channel, and said first contour forms a profiled part of said inlet opening and said second contour forms a profiled part of said outlet opening, said separating web has a shaped projection on a side facing away from said flat surface, said separating web forming a partial circumference of an area of one of said outlet channel and of said inlet channel said shaped projection also forms a partial circumference of an area of said outlet channel, said area of said outlet channel being essentially radial in relation to said impeller.

* * * * *